US006489868B1

(12) United States Patent
Sato et al.

(10) Patent No.: US 6,489,868 B1
(45) Date of Patent: Dec. 3, 2002

(54) ELECTROMAGNETIC RELAY

(75) Inventors: Shinichi Sato, Tokyo (JP); Yoshio Okamoto, Tokyo (JP); Shigemitsu Aoki, Tokyo (JP); Keiji Ikeda, Tokyo (JP); Masato Morimuta, Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/514,160

(22) Filed: Feb. 28, 2000

(30) Foreign Application Priority Data

Apr. 15, 1999 (JP) ..... 11-108307

(51) Int. Cl.[7] ..... H01H 51/22
(52) U.S. Cl. ..... 335/78; 335/128
(58) Field of Search ..... 335/78–81, 124, 335/128, 201; 218/7, 14, 154; 34/160–163

(56) References Cited

U.S. PATENT DOCUMENTS 4,004,260 A * 1/1977 Happach ..... 335/202
4,185,259 A * 1/1980 Fovarque ..... 335/167
4,402,033 A * 8/1983 Mayer ..... 361/187
4,404,443 A * 9/1983 Coynel et al. ..... 218/7
5,536,980 A * 7/1996 Kawate et al. ..... 361/160

FOREIGN PATENT DOCUMENTS

JP 6-260070 * 4/1991
JP 3-156822 * 7/1991
JP 8-195153 7/1996

* cited by examiner

*Primary Examiner*—Lincoln Donovan
(74) *Attorney, Agent, or Firm*—Staas & Halsey LLP

(57) ABSTRACT

The present invention provides an electromagnetic relay that has a long service life, even when being used for interrupting high voltage, and that can be miniaturized. In this electromagnetic relay, the circuit interruption is cut-off by two or more keying circuits, which are operated by a single coil and connected in series. Thus, an amount of generated arc per keying circuit is suppressed. Consequently, the service life of the electromagnetic relay is lengthened. Moreover, the space between the contacts thereof is reduced, so that the electromagnetic relay is miniaturized. Additionally, a magnetic field for extinguishing arc is formed by a back or counter electromotive force generated when the circuit is cut-off. Thus, the generated arc is extinguished.

4 Claims, 13 Drawing Sheets

| | 10V | 11V | 12V | 13V | 14V | 15V | 20V | 25V | 30V | 35V | 40V | 42V |
|---|---|---|---|---|---|---|---|---|---|---|---|---|
| MAX | 6.05 | 6.75 | 8.75 | 14.95 | 62.5 | 110.8 | 180.5 | 214 | 284.5 | 337 | 404 | 424 |
| ave | 5.3 | 6.02 | 8.1 | 12.16 | 34.23 | 81.34 | 161.45 | 197.45 | 253.6 | 322.7 | 384.4 | 389.8 |
| MIN | 4.55 | 5.05 | 7.2 | 10.4 | 15.7 | 22.4 | 142.5 | 157.5 | 222.5 | 306 | 355 | 349 |
| MAX | 5.4 | 8.1 | 9.8 | 15.6 | 53.2 | 61.2 | 57.8 | 69.6 | 135 | 182 | 212 | 238 |
| ave | 4.82 | 5.89 | 7.03 | 12.05 | 39.28 | 48.84 | 39.7 | 53.34 | 118.2 | 154.9 | 192 | 204.9 |
| MIN | 4.3 | 4.1 | 5.2 | 8.8 | 28 | 26.8 | 19.2 | 37.2 | 109 | 131 | 175 | 176 |

ELECTROMAGNETIC RELAY

BACKGROUND OF THE INVENTION

1. Field of the Invention

The present invention generally relates to an electromagnetic relay and, more particularly, to a small electromagnetic relay capable of cutting-off a high voltage.

2. Description of the Related Art

Recently, the motorization of car-mounted parts (for example, sideview mirrors and seats) has been promoted. Electromagnetic relays are frequently used for controlling supply of electric power to electric motors or solenoids, which act as electrically-driven actuators. Needless to say, compactness is required of car-mounted electromagnetic relays.

Further, if electric power is supplied thereto at a low voltage in a conventional manner even when the number of the electrically-driven parts is increased, the diameter of a wire harness for transfer of electric power becomes large. This results in increase in weight and cost of the wire harness. It has, thus, been proposed that a battery having a terminal voltage of 40 to 60 volts (V) should be used instead of the presently-used battery having a terminal voltage of 12 to 16 V.

Therefore, to control the supply of electric power to the electrically-driven actuator, currently, an electromagnetic relay capable of cutting-off a low voltage is used. Conversely, in future, the use of an electromagnetic relay capable of cutting-off a high voltage will be needed.

However, when high voltage is cut-off by the electromagnetic relay for cutting off low voltage, an arcing time at the cut-off becomes long, so that welding or sticking between the contacts of the electromagnetic relay easily occurs. Consequently, the service life of the contacts thereof becomes short.

There has been publicly known a method of broadening the space between the contacts of the electromagnetic relay so as to extend the service life of the contacts thereof. However, when the space therebetween is broadened, there is the necessity for increasing the size not only the contacts thereof but also of an electromagnetic coil so as to increase a magnetic force for operating the contacts thereof. Thus, the size of the entire eleptromagnetic relay inevitably becomes big.

The present invention is accomplished to solve the aforementioned problems. Accordingly, an object of the present invention is to provide an electromagnetic relay that has contacts, whose service life can be long, and can be miniaturized even when used for cutting-off a high voltage.

SUMMARY OF THE INVENTION

To achieve the foregoing object, according to the first aspect of the present invention, there is provided an electromagnetic relay that comprises an iron core, a coil wound around the iron core, an armature attracted by the iron core when electric power is supplied to the coil, a first common contact driven by the armature, a first make contact contacted with the common contact when the armature is attracted by the iron core, and an arc suppressing means for suppressing an occurrence of arc between the common contact and the make contact when the common contact is separated from the make contact by stopping supply of electric power to the coil.

Thus, according to this, aspect, an occurrence of arc between the common contact and the make contact is suppressed when the common contact is separated from the make contact. Consequently, the abrasion of the contacts is reduced. Further, the service life of the electromagnetic relay becomes long. Additionally, the space between the contacts is decreased, so that miniaturization of the electromagnetic relay is achieved.

According to the second aspect of the present invention, the arc suppressing means comprises at least one second common contact driven by the armature, at least one second make contact contacted with each of the at least one second common contacts when the armature is attracted to the iron core, and a series connecting means not only for serially connecting at least one second keying circuit each other, each of which consists of a second common contact and a second make contact, but also for serially connecting the serial connection of the at least one second keying circuit to the first keying circuit consisting of the first common contact and the first make contact.

Thus, according to this aspect, an occurrence of arc at the time of circuit interruption is suppressed by serially connecting two or more keying circuits, each of which comprises one common contact and one make contact.

According to the third aspect of the present invention, the arc suppressing means is arc extinguishing means for extinguishing an arc generated between the common contact and the make contact by using a magnetic field which is caused by electric current generated when the supply of electric power to the coil is stopped.

Thus, according to thIs aspect, arc generated between the contacts is extinguished by the magnetic field which is caused by the back electromotive force generated when the circuit is opened, and an electric current flowing in the arc.

BRIEF DESCRIPTION OF THE DRAWINGS

Other features, objects and advantages of the present invention will become apparent from the following description of preferred embodiments with reference to the drawings in which.

DETAILED DESCRIPTION OF THE PREFERRED EMBODIMENTS

Figure 1:
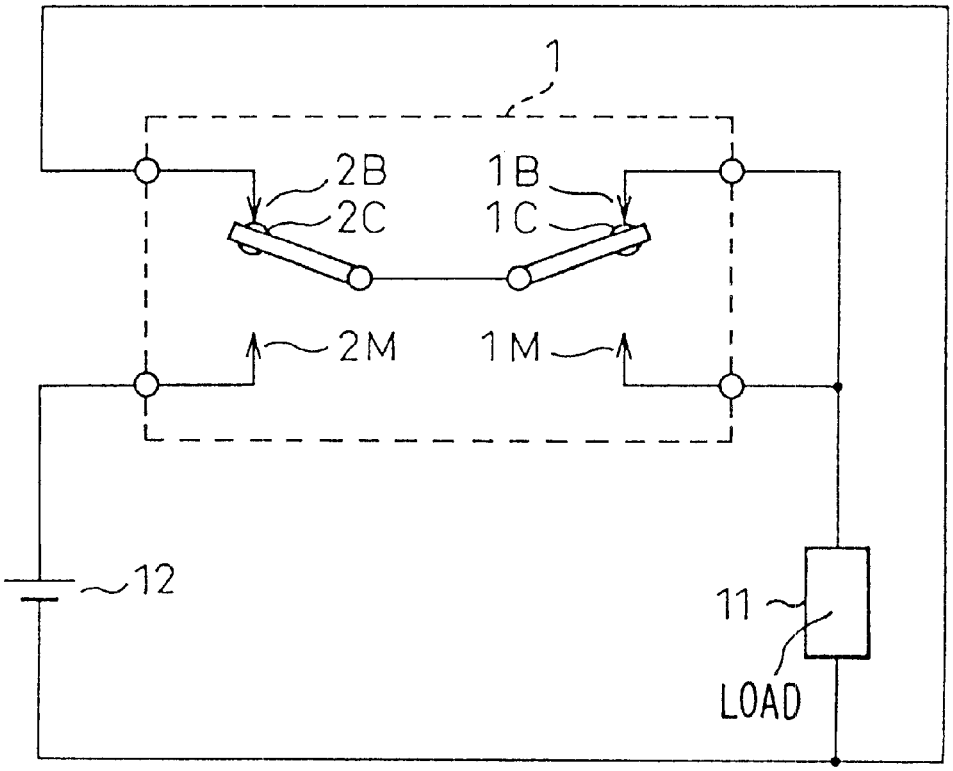
FIG. 1 is a circuit diagram illustrating an electric circuit of an electromagnetic relay according to the first embodiment of the present invention.
Figure 2:
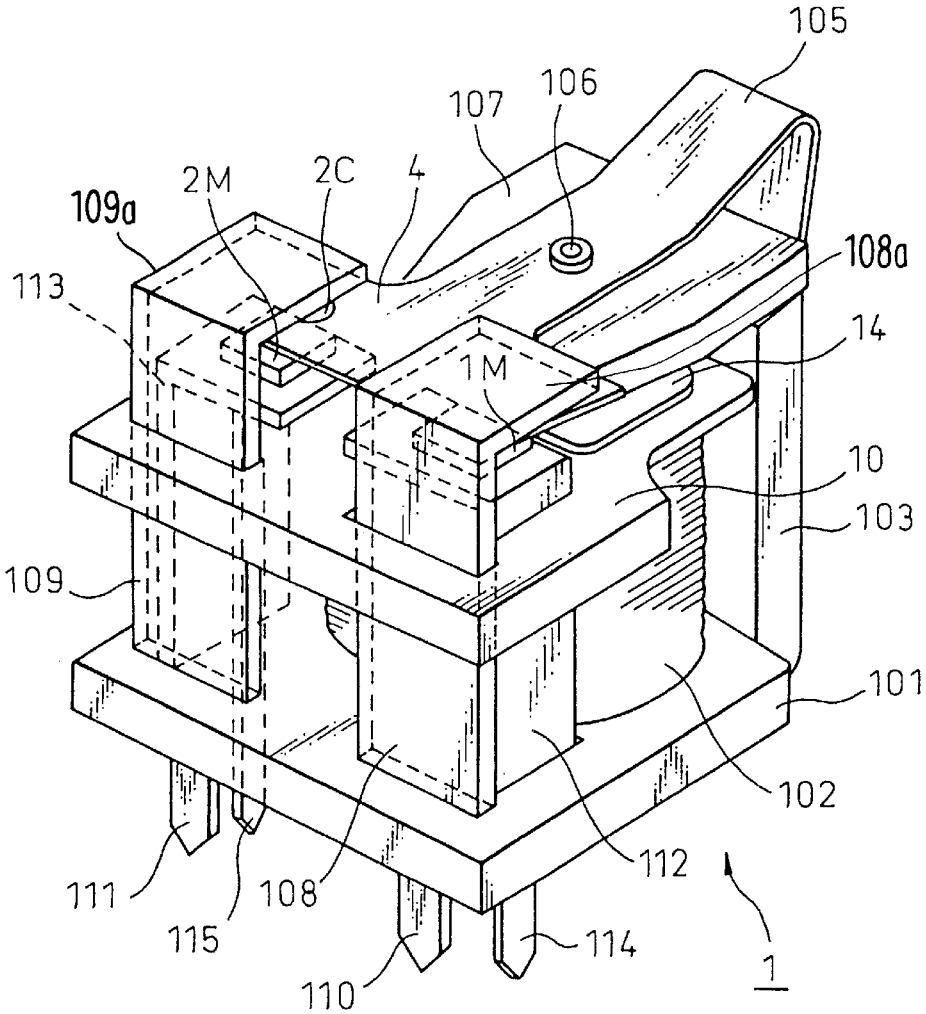
FIG. 2 is a perspective diagram illustrating the electromagnetic relay of FIG. 1.

FIG. 1 is a circuit diagram illustrating the electric circuit of an electromagnetic relay according to the first embodiment of the present invention. FIG. 2 is a perspective diagram illustrating the electromagnetic relay of FIG. 1. A load 11, such as an electric motor or a solenoid, is connected to a battery 12 functioning as a power source through an electromagnetic relay 1, which has two series-connected contacts.

The electromagnetic relay 1 has two common contacts (1C and 2C), two make contacts (1M and 2M), and two break contacts (1B and 2B). The two common contacts 1C and 2C are connected each other in the electromagnetic relay and have no terminal connected to external circuits.

Further, the first make contact 1M is connected to one of terminals of the load 11. The second make contact 2M is connected to a positive pole of the battery 12. Moreover, the other terminal of the load 11 is directly connected to the negative pole of the battery 12.

Therefore, when the coil of the electromagnetic relay is energised, the make contacts 1M and 2M contact with the two common contacts 1C and 2C, respectively. Thus, the load 11 receives electric power from the battery 12 and then starts acting. Conversely, when the coil of the electromagnetic relay is deenergised, the make contacts 1M and 2M are separated from the two common contacts 1C and 2C, respectively. Thus, the load 11 stops acting.

At that time, the separation of the first make contact 1M from the first common contact 1C and that of the second make contact 2M from the second common contact 2C are simultaneously performed. Power cut-off is performed by using the two series-connected contacts. As compared with the case that the power cut-off is performed by using one contact, the duration of arc generated when the contacts are separated is shortened. Consequently, the service life of the contacts is lengthened.

Incidentally, in the case that the load 11 is an inductive load such as an electric motor or a solenoid, it is preferable to short-circuit the load 11 to prevent it acting when electric power is not supplied thereto and for consuming a back electromotive force in a D.C. load.

Thus, in the first embodiment, the first break contact 1B is connected to one of the terminals of the load, while the second break contact 2B is connected to the other terminal of the load.

In the case of the electromagnetic relay 1 of the first embodiment which acts as described above, the first arm of a U-shaped yoke 103 penetrates a substrate 101 and extends upward. A coil 102 is wound around the arm. The second arm of the U-shaped yoke 103 extends upward along a side surface of the substrate 101.

A movable spring 105 is attached to an upper part of the second arm of the U-shaped yoke 103. The moving spring 105 is bent at a right angle in a direction of the former arm of the yoke 103, and extends horizontally beyond the first arm.

An armature 107 is attached to the movable spring 105 by a caulking member 106. Incidentally, the armature 107 is sized so that an end of the armature 107 contacts with the second arm of the yoke 103 and that the armature 107 covers the first arm of the U-shaped yoke 103. That is, the armature 107 closes an opening portion of the U-shaped yoke 103 and constitutes a closed magnetic circuit when the coil 102 is energised.

Two common contacts 1C and 2C are formed in a portion of the moving spring 105, which extends beyond the first arm of the U-shaped yoke 103. The movable spring 105 is made of an electrically conductive material, so that the two common contacts 1C and 2C are electrically connected to each other.

Two separate break contacts 1B and 2B are placed above the common contacts. Further, two separate make contacts 1M and 2M are placed under the common contacts.

Each of the two break contacts 1B and 2B is placed on the lower surfaces of two break contact support members 108 and 109 that are formed as a reversed-L shape and erected perpendicularly on the substrate 101. These break contact support members 108 and 109 are electrically conductive. The support members 108 and 109 connect, correspondingly, the two break contacts 1B and 2B with two break terminals 110 and 111, which project downwardly from the substrate 101.

The two make terminals 1M and 2M are placed on the upper surfaces of the two make contact support members 112 and 113 that are formed as a reversed-L shape and are erected perpendicularly on the substrate 101. These make contact support members 112 and 113 are electrically conductive. The make contact support members 112 and 113 connect, correspondingly, the two make contacts 1M and 2M to the two make terminals 114 and 115, which project downwardly from the substrate 101.

Figure 3:
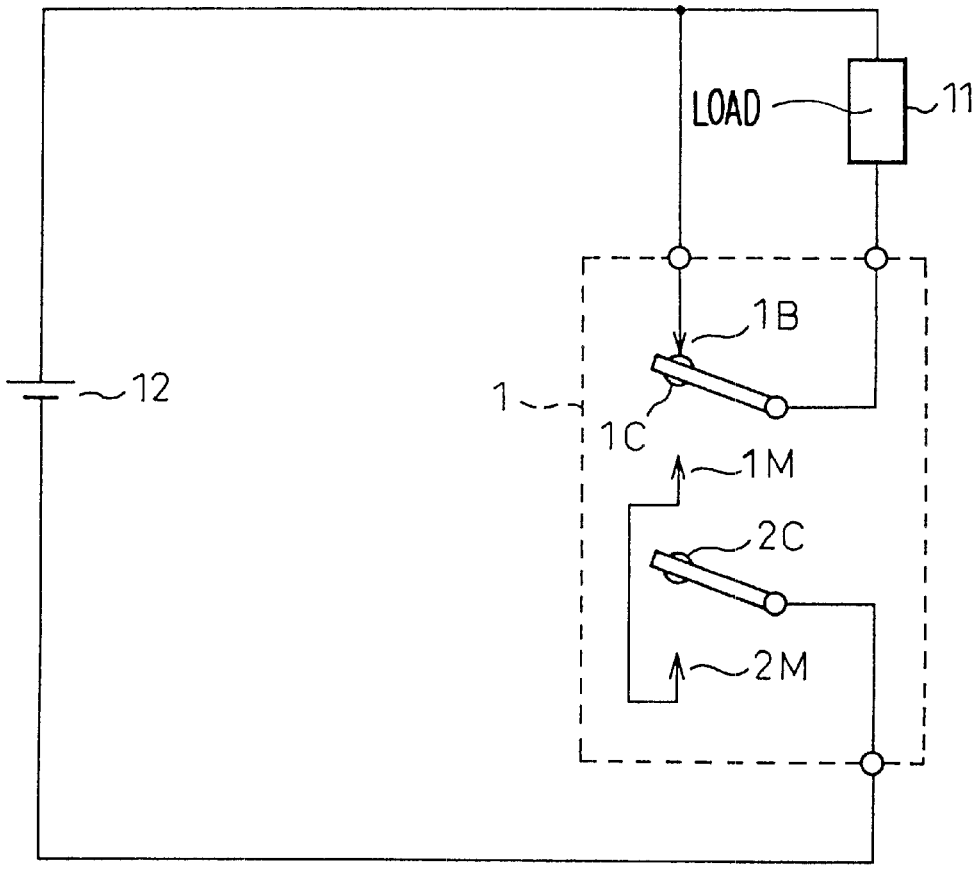
FIG. 3 is a circuit diagram illustrating an electric circuit of an electromagnetic relay according to the second embodiment of the present invention.
Figure 4:
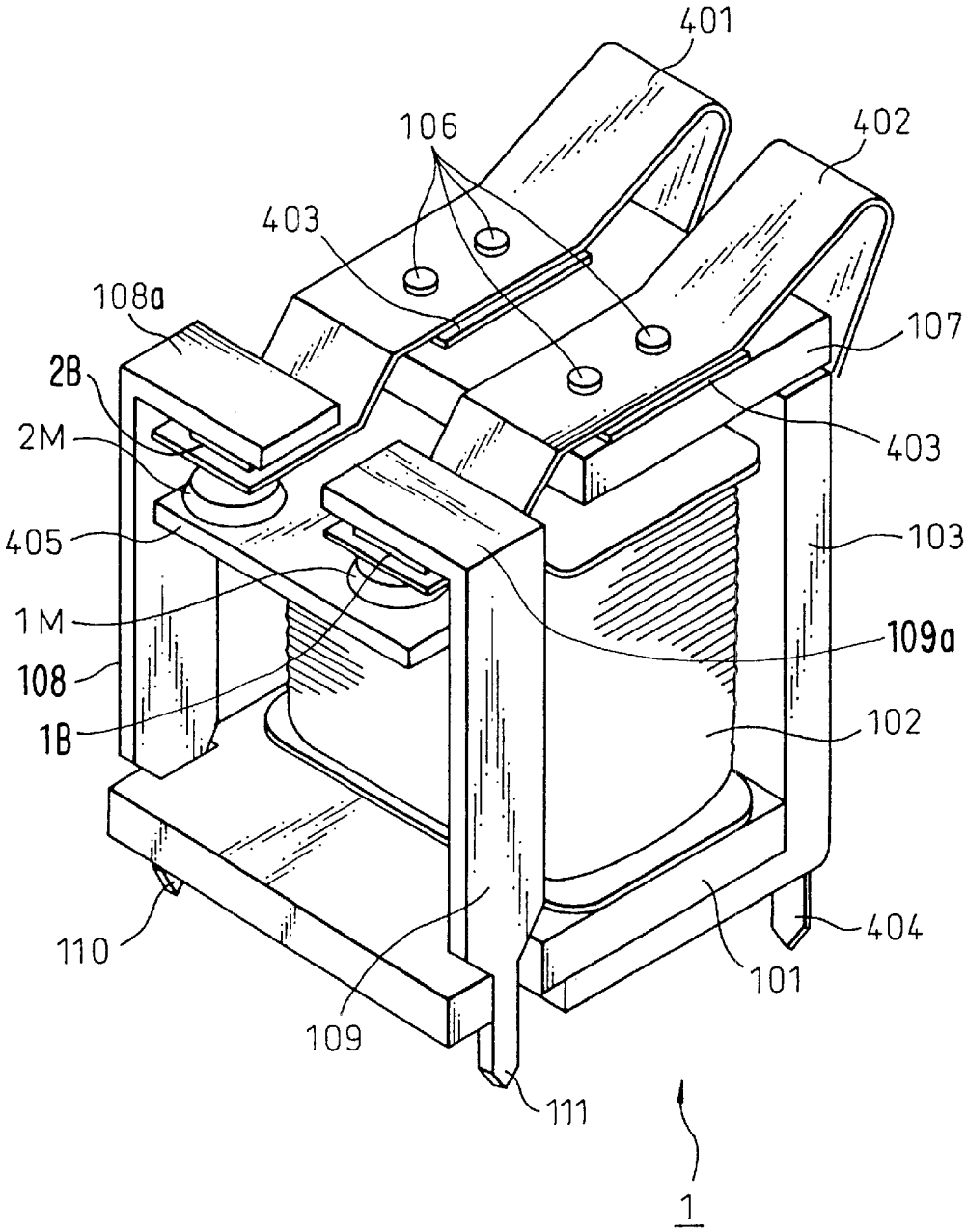
FIG. 4 is a perspective diagram illustrating the electromagnetic relay of FIG. 3.

FIG. 3 is a circuit diagram illustrating the electric circuit of an electromagnetic relay according to the second embodiment of the present invention. FIG. 4 is a perspective diagram illustrating the electromagnetic relay of FIG. 3. A load 11 is connected to a battery 12 functioning as a power source through an electromagnetic relay 1, which has two series-connected contacts.

The electromagnetic relay 1 has two common contacts (1C and 2C), two make contacts (1M and 2M), and two break contacts (1B and 2B). The two make contacts 1M and 2M are internally connected to each other in the electromagnetic relay and have no terminal connected to external circuits. The first common contact 1C is connected to one of terminals of the load 11. The second make contact 2C is connected to a negative pole of the battery 12. Moreover, the first break contact 1B, the other terminal of the load 11, and a positive pole of the battery 12 are connected in common.

Therefore, when the coil of the electromagnetic relay is energised, the make contacts 1M and 2M contact with the two contacts 1C and 2C, respectively. Thus, the load 11 receives electric power from the battery 12 and then starts acting. Conversely, when the coil of the electromagnetic relay is deenergised, the make contacts 1M and 2M are separated from the two common contacts 1C and 2C, respectively. Thus, the load 11 stops acting.

Incidentally, in this embodiment, the load 11 is preferably short-circuited as in the first embodiment. Thus, in the second embodiment, the first break terminal 1B is connected to the latter terminal of the load 11.

In the case of the electromagnetic relay 1 of the second embodiment acting as described above, the first arm of a U-shaped yoke 103 penetrates a substrate 101 and extends upward. A coil 102 is wound around it. The second arm of the U-shaped yoke 103 extends upward along the side surface of the substrate 101.

Two moving springs 401 and 402 are electrically insulated from the yoke 103 and one end of each is attached to an upper part of the second arm of the U-shaped yoke 103. The other ends of the moving springs 401 and 402 are bent at a right angle in a direction of the first arm of the yoke 103, and extend horizontally beyond the first arm. Incidentally, one end of each of the moving springs 401 and 402 extends downward beyond the bottom of the U-shaped yoke 103, and are respectively connected to a first common terminal (not shown) and a second common terminal 404.

An armature 107 is attached to the moving springs 401 and 402 through an insulating member 403 by caulking members 106. Incidentally, the armature 107 is sized so that one edge of the armature 107 contacts with the second arm of the U-shaped yoke 103 and that the armature 107 covers the first arm of the U-shaped yoke 103. That is, the armature 107 closes an opening portion of the U-shaped yoke 103 and constitutes a closed magnetic circuit when the coil 102 is energised.

Two common contacts 1C and 2C are formed at an extending portion of the first arm of the U-shaped yoke 103.

Two separate break contacts 1B and 2B are placed above the common contacts. Further, two separate make contacts 1M and 2M formed on an electrically conductive substrate are placed under the common contacts.

The two break contacts 1B and 2B are placed on the lower surface of two break contact support members 108 and 109 that are formed as a reversed-L shape and erected perpendicularly on the substrate 101. These break contact support members 108 and 109 are electrically conductive. The support members 108 and 109 connect the two break contacts 1B and 2B to the two break terminals 110 and 111, which project downward from the substrate 101.

The make substrate 405 is electrically insulated from the two break contact support members 108 and 109, which are formed as a reversed-L shape, and is fixed by a suitable method, for example, by being screwed.

Figure 5:
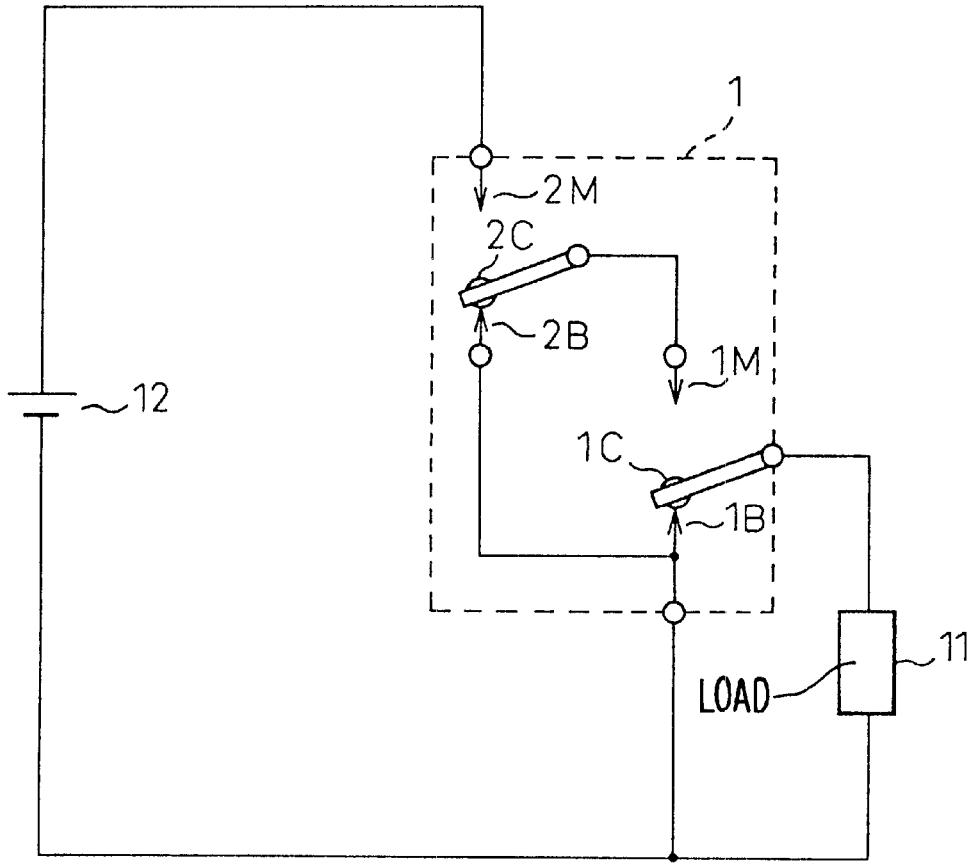
FIG. 5 is a circuit diagram illustrating an electric circuit of an electromagnetic relay according to the third embodiment of the present invention.
Figure 6:
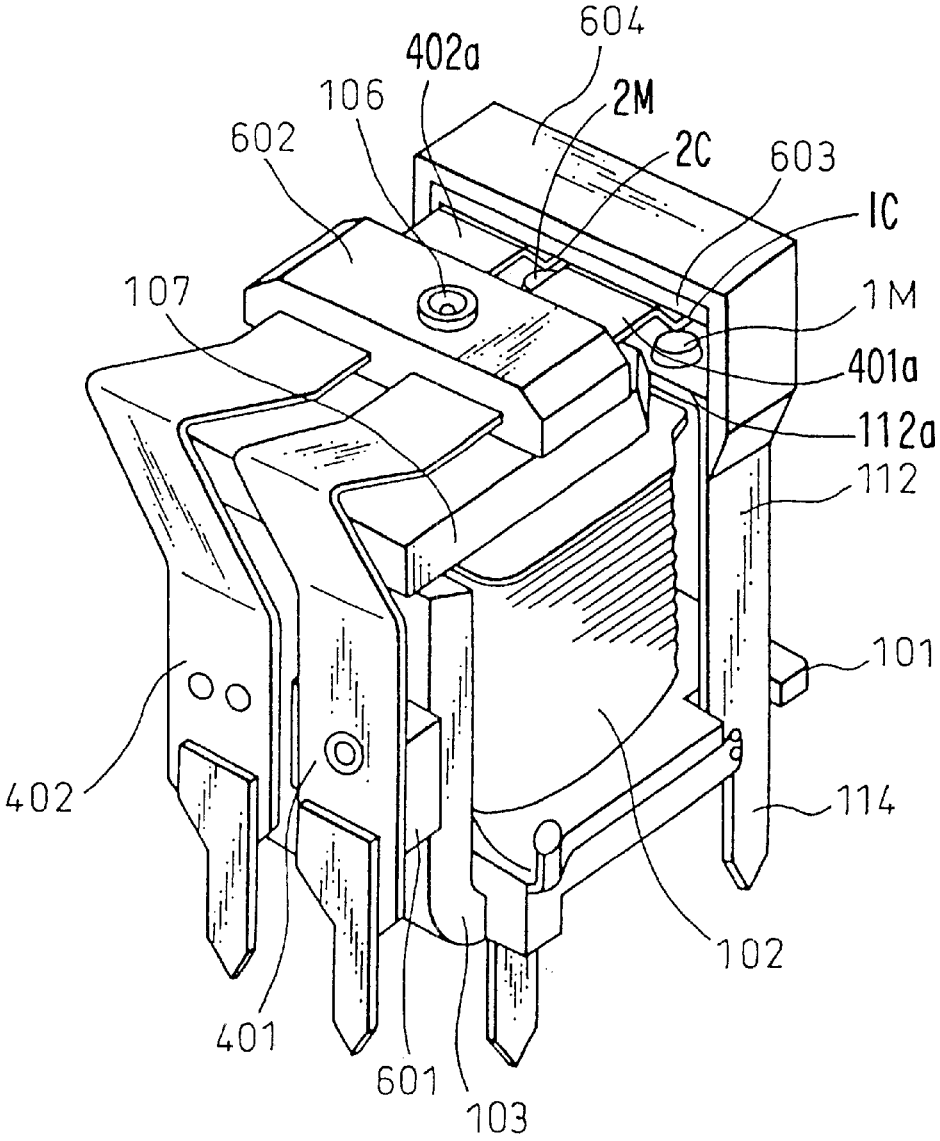
FIG. 6 is a perspective diagram illustrating the electromagnetic relay of FIG. 5.

FIG. 5 is a circuit diagram illustrating the electric circuit of an electromagnetic relay according to the third embodiment of the present invention. FIG. 6 is a perspective diagram illustrating the electromagnetic relay of FIG. 4. A load 11 is connected to a battery 12 functioning as a power source through an electromagnetic relay 1, which has two series-connected contacts.

The electromagnetic relay 1 has two common contacts (1C and 2C), two make contacts (1M and 2M), and two break contacts (1B and 2B). The first make contact 1M and the second make contact 2M are connected to each other in the electromagnetic relay and have no terminal connected to external circuits. The first common contact 1*c* is connected to one terminal of the load 11. The second make contact 2C is connected to a positive pole of the battery 12. Moreover, the other terminal of the load 11 and a negative pole of the battery 12 are directly connected to each other.

Therefore, when the coil of the electromagnetic relay is energised, the make contacts 1M and 2M contact with the two contacts 1C and 2C, respectively. Thus, the load 11 receives electric power from the battery 12 and then starts acting. Conversely, when the coil of the electromagnetic relay is deenergised, the make contacts 1M and 2M are separated from the two common contacts 1C and 2C, respectively. Thus, the load 11 stops acting.

Incidentally, if the load 11 is an electric motor, the load 11 is preferably short circuited as in the first embodiment. Thus, in the third embodiment, the first break terminal 1B is connected to one of terminals of the load 11.

In the case of the electromagnetic relay 1 of the third embodiment acting as described above, the first arm of a U-shaped yoke 103 penetrates a substrate 101 and extends upward. A coil 102 is wound around the first arm. The second arm of the U-shaped yoke 103 extends upward along a side surface of the substrate 101.

Two moving springs 401 and 402 are attached to an upper surface of the second arm of the U-shaped yoke 103. The moving springs 401 and 402 are bent at a right angle in a direction of the first arm of the yoke 103, and extend horizontally beyond the first arm. Incidentally, the first moving spring 401 is connected through an insulating member 601 to the second arm of the yoke and the second moving spring 402 is connected directly to it.

An insulating member 602 is placed on a horizontal part of the two moving springs 401 and 402 and just above the second arm of the yoke so that the two moving springs 401 and 402 do not contact with each other. Further, an armature 107 is attached to a central portion of the insulating member 602 by a caulking member 106. Incidentally, the armature 107 is sized so that an end edge of the armature 107 contacts with the second arm of the U-shaped yoke 103 and that the armature 107 covers the first arm of the U-shaped yoke 103. That is, the armature 107 closes an opening of the U-shaped yoke 103 and constitutes a closed magnetic circuit when the coil 102 is energised.

Two common contacts 1C and 2C are formed in an extending portion of the first arm of the U-shaped yoke 103.

Two break contacts 1B and 2B are placed above the common contacts. That is, the two break contacts 1B and 2B are electrically connected by an electrically conductive break contact substrate 603. Further, two separate make contacts 1M and 2M are placed under the common contacts.

The break contact substrate 603 is attached to a break contact support member 604, which is erected perpendicularly on the substrate 101 and formed like a reversed-L shape. The electrically conductive member provided inside the break contact support member 604 connects the break contact substrate 603 to a break terminal (not shown) protruding downward from the substrate 101.

The two make contacts, 1M and 2M are placed on the upper surfaces of the two make contact support members 112 and 113 (not shown) that are formed as a reversed-L shape and erected perpendicularly on the substrate 101. These make contact support members 112 are electrically conductive. The support members 112 and 113 connect the two make contacts 1M and 2M with the two break terminals 114, which project downward from the substrate 101. Incidentally, the first make contact 1M is directly provided on the U-shaped yoke 103, so that the first make contact 1M is electrically connected to the second common terminal 2C.

Figure 7A:
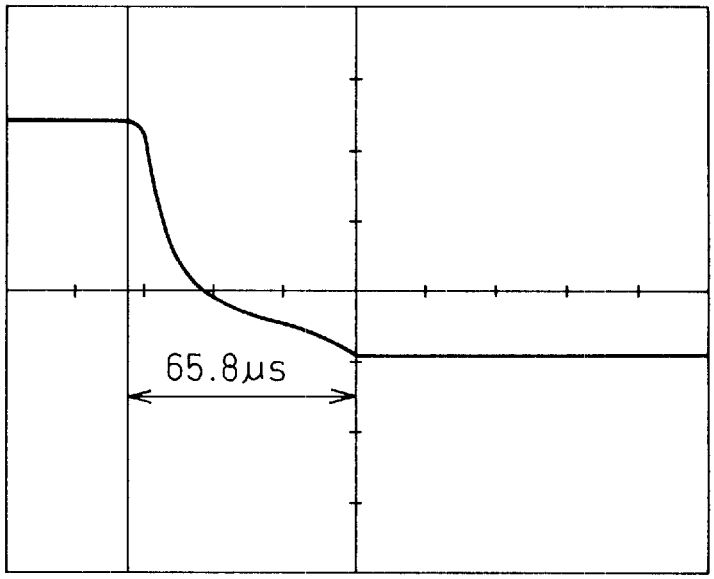
FIGS. 7A and 7B are graphs illustrating effects of the first to third embodiments of the present invention.
Figure 7B:
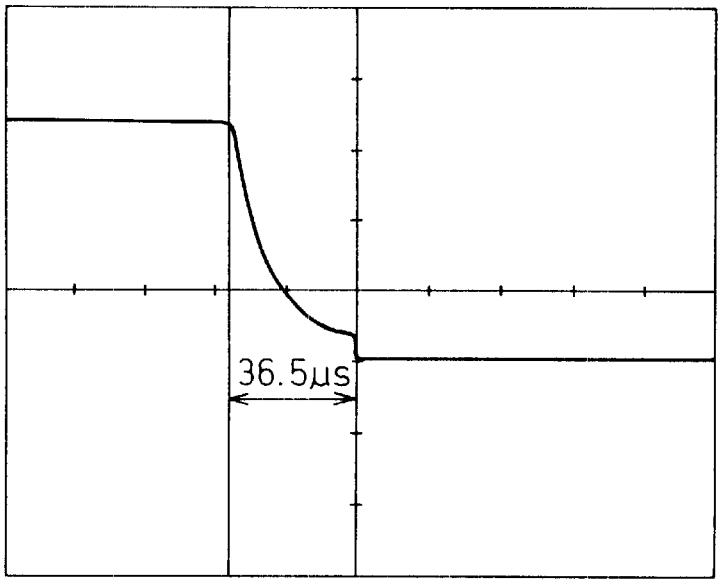

FIGS. 7A and 7B are graphs illustrating effects of the first to third embodiments of the present invention. FIG. 7A illustrates a transient characteristic of the voltage across the load when the circuit is cut-off by one cut-off element comprised of a make contact and a common contact. FIG.

7B. illustrates a transient characteristic of the voltage across the load when the circuit is cut-off by two series connected cut-off elements, each of which is comprised of a make contact and a common contact. In each of these two graphs, the ordinate represents the voltage across the load, while the abscissa represents time.

As shown in these graphs, the time required to completely separate the make contact from the common contact in FIG. 7A is 65.8 μsec., while in FIG. 7B 36.5 μsec. Thus, the arcing time of the relay according the present invention is, reduced by half.

Figure 8:
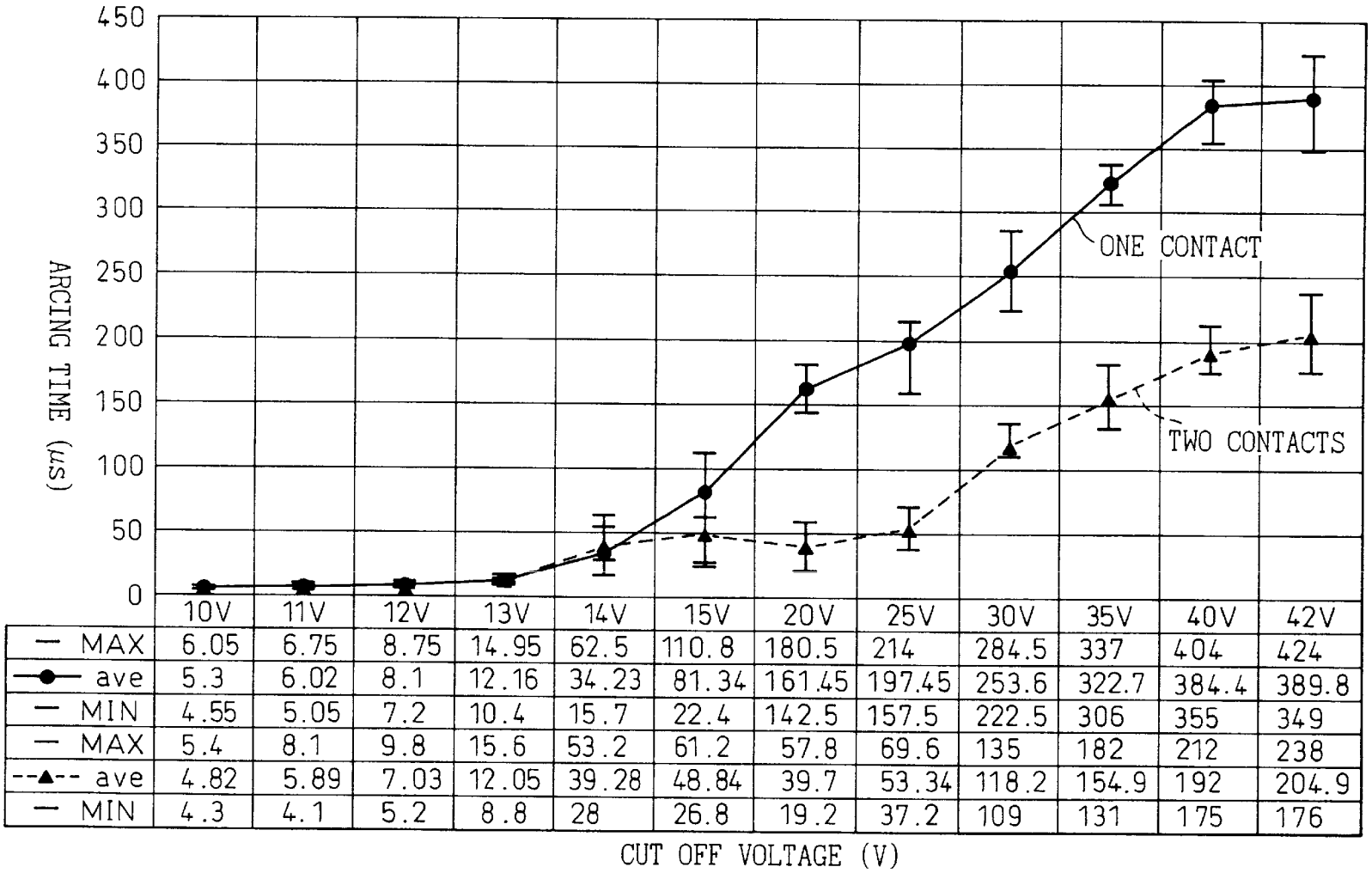
FIG. 8 is a graph illustrating effects of the present invention.

FIG. 8 is a graph illustrating the effects of the present invention. This graph shows the relation between the cutoff voltage (V) and the arcing time (μsec.) when the circuit is cut-off bygone cut-off element and two cut-off elements. In this graph, the ordinate represents the arcing time, while the abscissa represents the cutoff voltage.

As shown in this graph, when the cutoff voltage is increased, the arcing time when applying two series connected cut-off elements is a half of that when applying one cut-off elements.

Namely, in the case of the first to third embodiments, the arcing time thereof can be reduced by a half of that when applying a single cut-off element. The service life of the contacts can be lengthened.

As described above, the first to third embodiments shorten the arcing time and lengthen the service time of contact by applying a plurality of series connected cut-off elements. However, the service life of the contacts can be lengthened by adopting a magnetic arc extinguishing method in which a magnet is placed in the vicinity of the contact and the arc is extinguished by a magnetic force.

Figure 9:
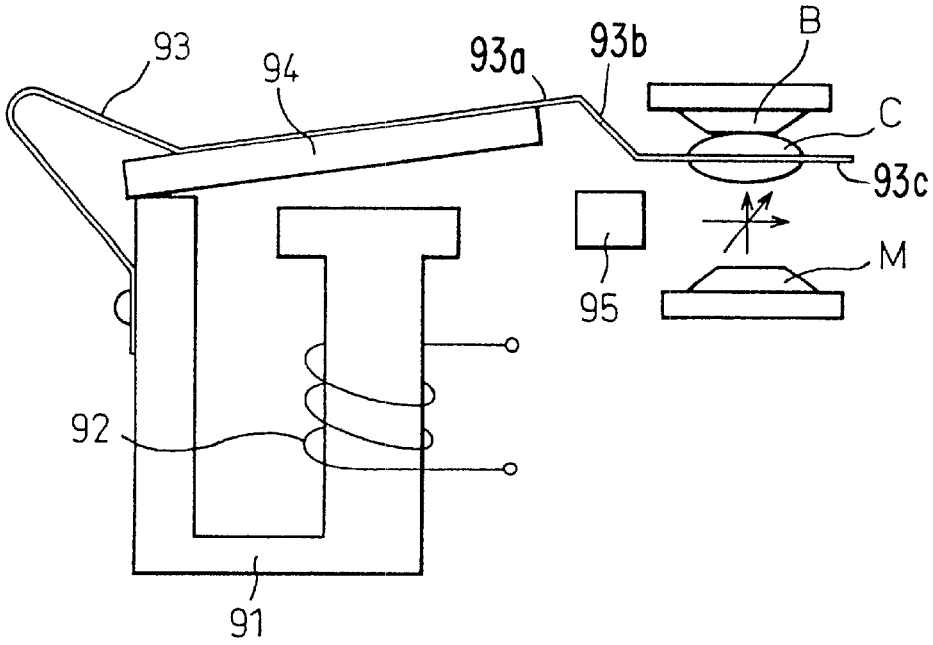
FIG. 9 is a diagram illustrating the principle of a magnetic arc extinguishing electromagnetic relay.

FIG. 9 is a diagram illustrating the principle of an electromagnetic relay with a magnetic arc extinguishing mechanism in which a primary coil 92 is wound around the first arm of a U-shaped yoke 91.

A blade spring 93 is attached to an upper part of the second arm of the yoke 91. The blade spring 93 is bent nearly at a right angle and has a part that extends beyond the first arm of the yoke 91. An armature 94 is attached to this part of the blade spring 93 having an end that is in contact with the first arm of the yoke 91. Incidentally, the armature 94 is sized to cover the first arm of the yoke 91. The armature 94 functions to short circuit an opening portion of the U-shaped yoke 91 and to constitute a closed magnetic circuit when the primary coil 92 is energised.

A common contact C is formed at the tip of the extended part of the blade spring 93. A break contact B and a make contact M are respectively placed above and under the common contact C. Further, a magnet 95 is disposed in the proximity of the common contact C and the make contact M so that a magnetic field is generated in a gap between the common contact C and the make contact M.

That is, when the primary coil 92 is energised, the common contact C contacts with the make contact M. Conversely, when the primary coil 92 is deenergised, the make contact M is separated from the common contact C. However, when circuit is cut-off by separating the common contact C from the make contact M, an arc is generated between the common contact C and the make contact M. A force based on the Fleming's left-hand rule acts in a direction perpendicular to an electric current flowing in the arc and a magnetic field in the gap between the common contact C ad the make contact M. As a result, the arc is pushed out from the gap between the contacts. Thus, abrasion of the contacts due to the arc is suppressed.

The electromagnetic relay with a magnetic arc extinguishing mechanism can use a permanent magnet as the magnet 95. However, in view of the facts that the permanent magnet is costly and that a magnetic field is applied only when the circuit is cut-off, the electromagnetic relay of the present invention generates a magnetic field, for extinguishing arc, by using the back electromotive force, caused when the primary coil 92 is deenergised.

Figure 10:
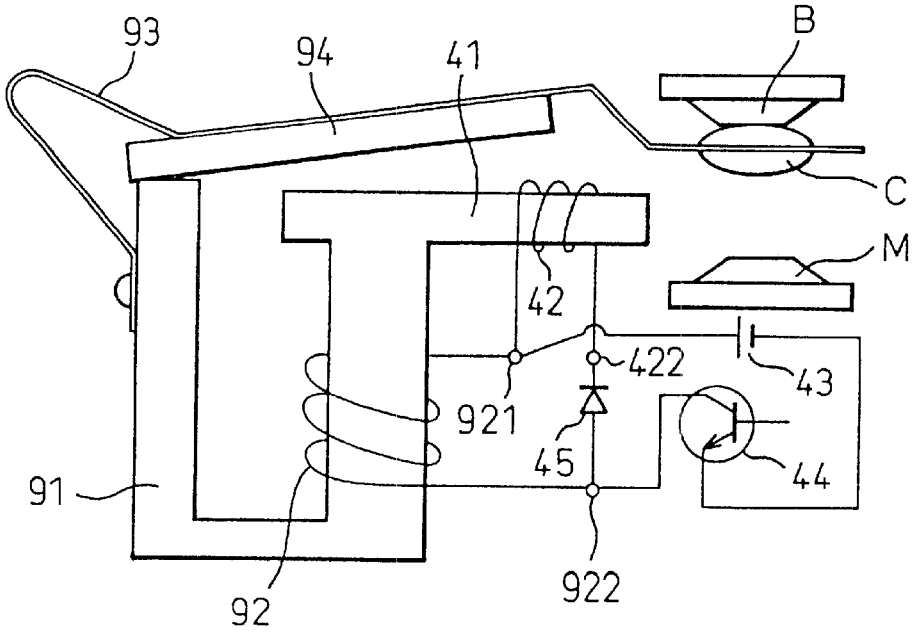
FIG. 10 is a diagram schematically illustrating the constitution of an electromagnetic relay according to the fourth embodiment of the present invention.

FIG. 10 is a diagram schematically illustrating the constitution of an electromagnetic relay according to the fourth embodiment of the present invention. Incidentally, same reference numerals designate same constituent elements of FIG. 9.

In the fourth embodiment, an extension yoke 41, which extends to a direction of a make contact M at the upper part of one of the,arms of the U-shaped yoke 91, and an extinguishing coil 42 wound around this extension yoke 41 are added to the constituent elements of FIG. 9 which shows the principle of the electromagnetic relay.

A primary coil 92 is connected in series to an exciting power supply 43 and a switching device 44. Further, the extinguishing coil 42 is connected in parallel to the primary coil 72 through a reverse-current blocking diode 45 for preventing an energising current from flowing through the extinguishing coil 42 when primary coil 92 is energised by turning on the switching device 44.

Namely, in the embodiment shown in FIG. 10, the primary coil 92 and the extinguishing coil 42 have a common beginning end 921 of the winding. A reverse-current blocking diode 45 is connected between the terminating end 922 of the primary coil 92 and the terminating end 422 of the extinguishing coil 42 so that the cathode of the diode 45 is connected to the terminating end 922 of the extinguishing coil and its anode is connected to the terminating end 922 of the primary coil. Further, the beginning end 921 of the primary coil 92 is connected to the positive pole of the energising power source 43. The terminating end 922 of the primary coil 92 is connected to the negative pole of the energising power source 43 through the switching device 44.

Figure 11:
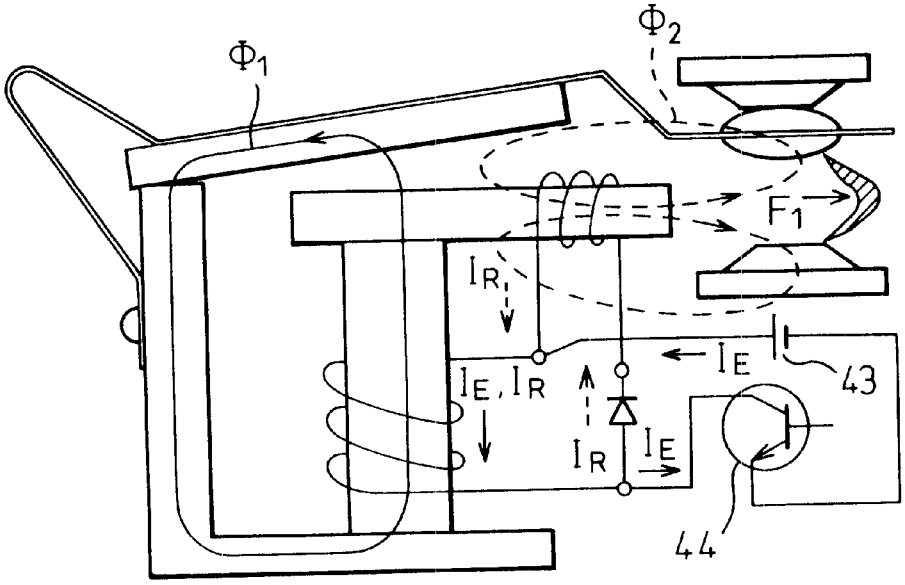
FIG. 11 is a diagram illustrating a situation in which a magnetic flux is generated when a switching device is turned off.
Figures 12A, 12B, 12C, 12D:
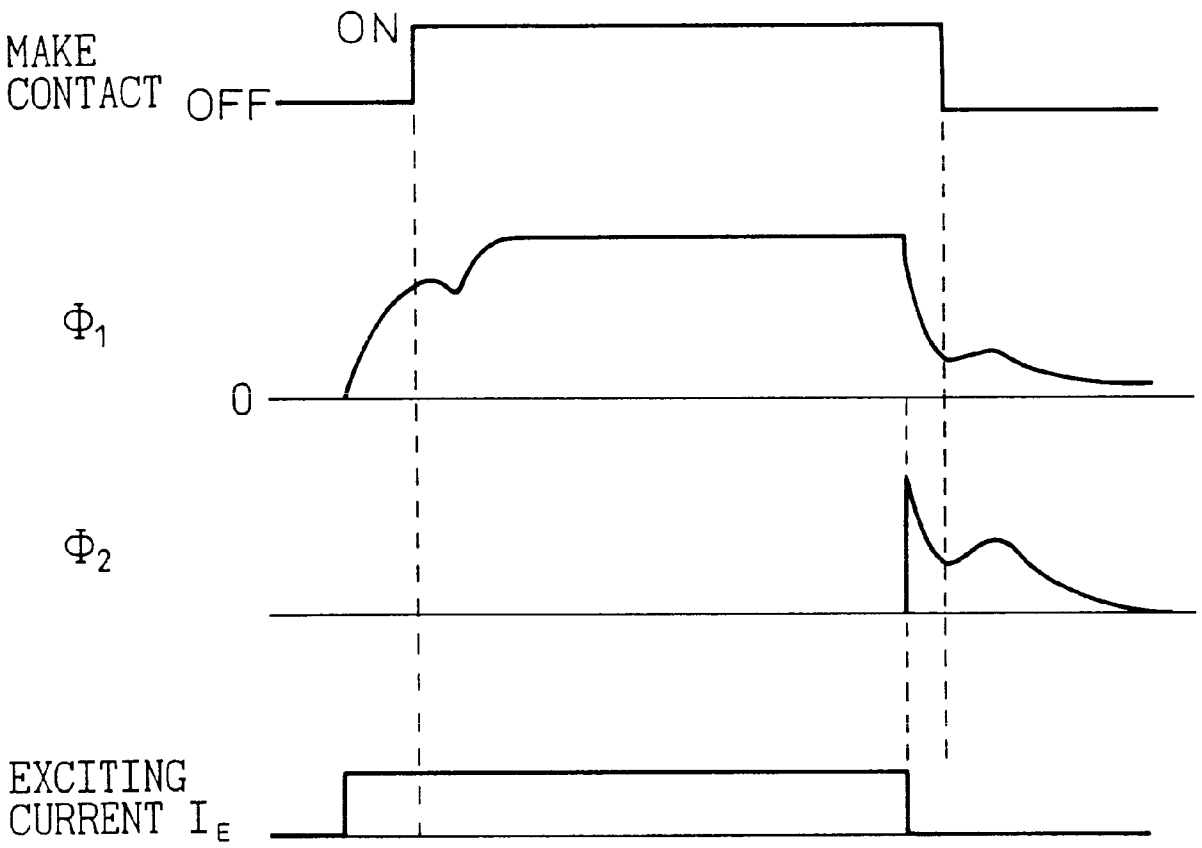
FIGS. 12A to 12D are graphs illustrating the transient characteristics of a make contact, magnetic fluxes generated in a closed magnetic circuit and an extension yoke, and the exciting current.

FIG. 11 is a diagram illustrating a situation in which a magnetic flux is generated when the switching device 44 is turned off. FIGS. 12A to 12D are graphs respectively illustrating the state of the make contact, a magnetic flux $\phi_1$ generated in a closed magnetic circuit, a magnetic flux $\phi_2$ generated in the extension yoke, and the exciting current.

When the switching device 44 is turned on in this embodiment, the energising current $I_E$ flows through the primary coil 92. This energising current is, however, blocked by the reverse-current blocking diode 45, and thus does not flow into the extinguishing coil 42. Therefore, when the primary coil 92 is energised, the magnetic flux $\phi_1$ is generated in the closed magnetic circuit formed by covering an opening portion of the U-shaped yoke 91 with the armature 94. Conversely, the magnetic flux is not generated in the extension yoke 41.

When the switching device 44 is turned off, the magnetic flux $\phi_1$ generated in the closed magnetic circuit composed of the U-shaped yoke 91 and the armature 94 is extinguished. At that time, a back electromotive force is generated in the closed magnetic circuit, so that electric current $I_R$ flows in the primary coil 92 in a direction opposite to the direction of the electric current $I_E$ generated when the primary coil is energised. This opposite current flows through the reverse current blocking diode 45, and also flows in the extinguishing coil 42. Thus, a magnetic flux $\phi_2$ is generated in the extension yoke 41 and the gap between the common contact C and the make contact M, so that a magnetic field is generated. Then, a force $F_1$ caused by the interaction between this magnetic field and the electric current flowing in the arc generated between the common contact C and the make contact M is applied to the arc. Consequently, the arc is extinguished.

Figure 13:
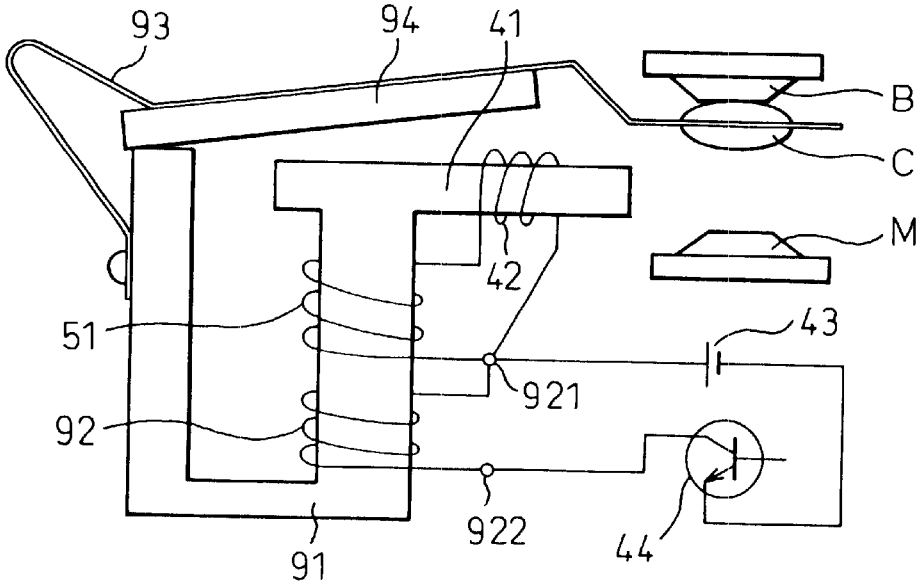
FIG. 13 is a diagram schematically illustrating the constitution of an electromagnetic relay according to the fifth embodiment of the present invention.

FIG. 13 is a diagram schematically illustrating the constitution of an electromagnetic relay according to the fifth embodiment of the present invention. Incidentally, same reference numerals designate same constituent elements of FIGS. 9 and 10.

In the fifth embodiment, an extension yoke 41, which extends in a direction of the make contact M at an upper part of one of the arms of the U-shaped yoke 91, an extinguishing coil 42 wound around this extension yoke 41, and an auxiliary coil 51 wound around the first arms of the U-shaped yoke 91 are added to the constituent elements of FIG. 9 illustrating the principle of the electromagnetic relay. The reverse current blocking diode 45 is unnecessary.

The beginning end 921 of the winding of the primary coil 92, and the terminating ends of the auxiliary coil 51 and the extinguishing coil 42 are connected in common. Moreover, the terminating end of the auxiliary coil 51 and that of the extinguishing coil 42 are connected in common.

Further, an energising circuit consisting of the energising power source 43 and the switching device 44, which are connected in series, is connected between the beginning end 921 and the terminating end 922 of the primary coil 92.

Figure 14:
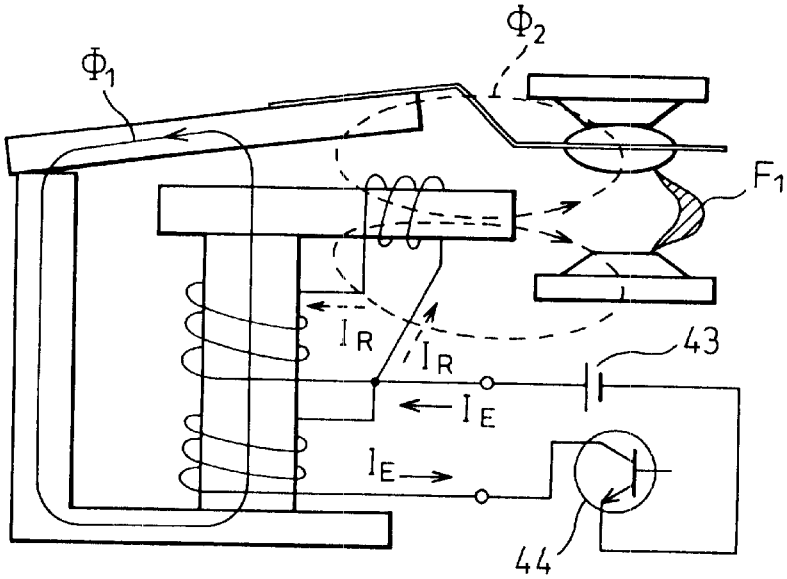
FIG. 14 is a diagram illustrating a situation in which a magnetic flux is generated.
Figures 15A, 15B, 15C, 15D, 15E:
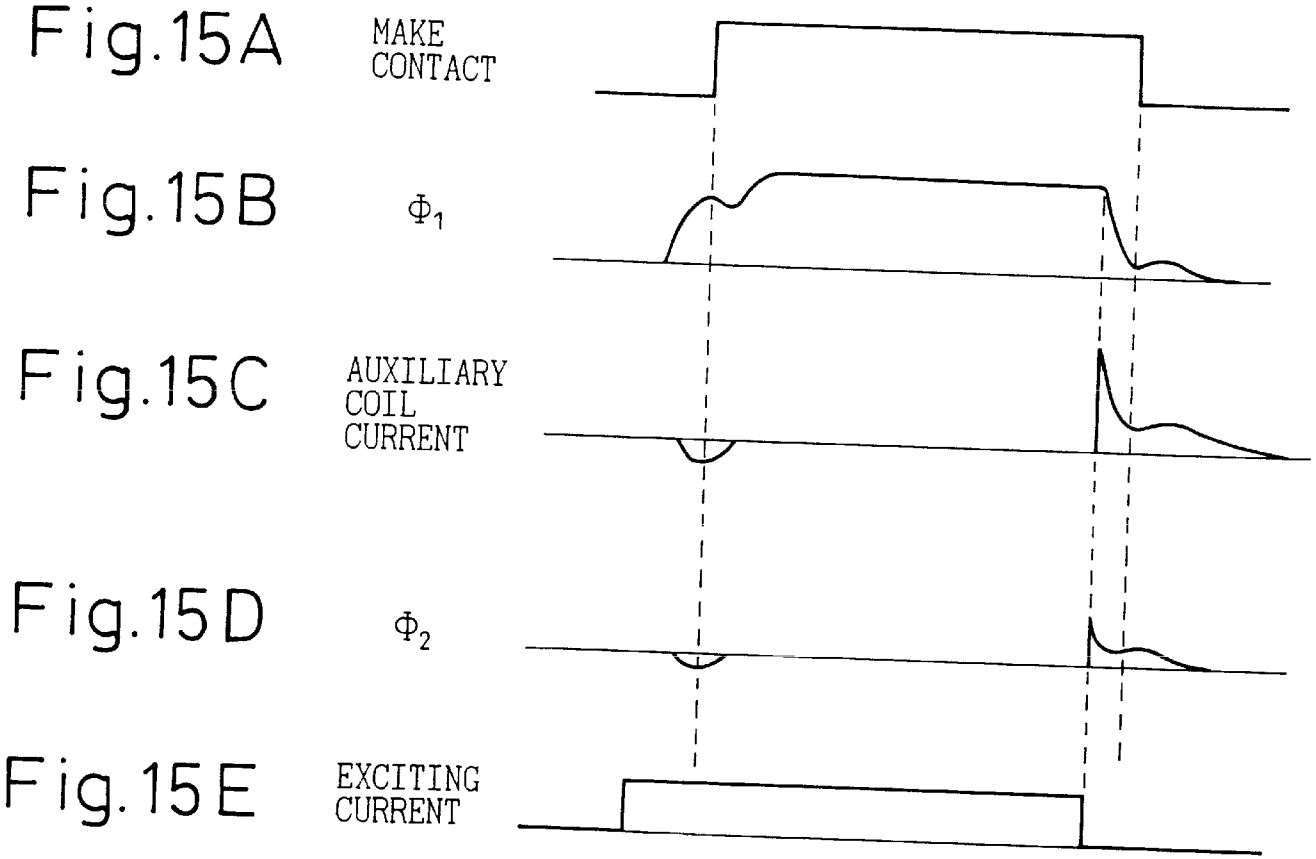
FIGS. 15A to 15E are graphs illustrating the transient characteristics of a make contact, a magnetic flux generated in a closed magnetic circuit, electric current flowing through an auxiliary coil, a magnetic flux generated in an extension yoke, and the existing current.

FIG. 14 is a diagram illustrating a situation in which a magnetic flux is generated when the switching device 44 is turned off. FIGS. 15A to 15E are graphs respectively illustrating the state of the make contact, a magnetic flux $\phi_1$ generated in a closed magnetic circuit, an electric current flowing through the auxiliary coil, a magnetic flux $\phi_2$ generated in the extension yoke 41, and the energising current.

When the switching device 44 is turned on, the magnetic flux $\phi_1$ is generated in the U-shaped yoke 91, and the make contact contacts with the common contact. When the magnetic flux $\phi_1$ is generated, the electric current $I_E$ is caused in the auxiliary coil 51, and the magnetic flux $\phi_2$ is generated in the extension yoke 41. This, however, has no special effects.

When the switching device 44 is turned off, the magnetic flux $\phi_1$ generated in the U-shaped yoke 91 is extinguished. However, a back electromotive force generated at that time causes electric current $I_R$ to flow in the auxiliary coil 51 and the arc extinguishing coil 42. Thus, a magnetic flux $\phi_2$ is generated in the extension yoke 41 and the gap between the common contact C and the make contact M, so that a magnetic field is generated. Then, a force caused due to the interaction between this magnetic field and the electric current flowing in the arc generated between the common contact C and the make contact M is applied to the arc. Consequently, the arc is extinguished.

Although the preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. An electromagnetic relay, comprising:

a ferro magnetic iron core;

a coil wound on said ferromagnetic iron core;

an armature attracted by said ferromagnetic iron core when electric power is supplied to said coil;

a first common contact driven by said armature;

a first make contact which contacts said first common contact when said armature is attracted by said ferromagnetic iron core; and means for suppressing an arc, generated between said first common contact and said first make contact when separating said first common contact from said first make contact, by stopping supply of electric power to said coil, comprising:

a key circuit or a plurality of series-connected key circuits, connected in series with said first common contact, a load and a battery, wherein each key circuit comprises a second common contact driven by said armature and a second make contact which is contacted by said second common contact when said armature is attracted by said ferromagnetic iron core.

2. An electromagnetic relay as recited in claim 1, further comprising:

a first break contact connected in series with the load when the supply of electric power to said coil is stopped and the armature is released from the make contact and contacts the break contact; and the keying circuit, or each of the plurality of series-connected keying circuits, comprises a second break contact connected in series with the first break contact and the load when the second common contact of each keying circuit is released from the second make contact when the supply of electric power to said coil is stopped.

3. An electromagnetic relay, comprising:

a ferromagnetic iron core;

a coil wound on said ferromagnetic iron core;

an armature attracted by said ferromagnetic iron core when electric power is supplied to said coil;

a first common contact driven by said armature;

a first make contact which contacts said first common contact when said armature is attracted by said ferromagnetic iron core; and an arc suppressing circuit which suppresses an arc, generated between said first common contact and said first make contact when separating said first common contact from said first make contact, by stopping supply of electric power to said coil, comprising:

a key circuit or a plurality of series-connected key circuits, connected in series with said first common contact, a load and a battery, wherein each key circuit comprises a second common contact driven by said armature and a second make contact which is contacted by said second common contact when said armature is attracted by said ferromagnetic iron core.

4. An electromagnetic relay as recited in claim 3, further comprising:

a first break contact connected in series with the load when the supply of electric power to said coil is stopped and the armature is released from the make contact and contacts the first break contact; and the keying circuit, or each of the plurality of series-connected keying circuits, comprises a second break contact connected in series with the first break contact and the load when the second common contact of each keying circuit is released from the second make contact when the supply of electric power to said coil is stopped.

* * * * *